US011641986B2

(12) United States Patent
Bing et al.

(10) Patent No.: US 11,641,986 B2
(45) Date of Patent: May 9, 2023

(54) MULTI-ORIENTATION TOWEL DISPENSER

(71) Applicant: Cintas Corporate Services, Inc., Cincinnati, OH (US)

(72) Inventors: Richard R. Bing, West Chester, OH (US); Megan Kathryn Helms, Hamilton, OH (US); David Steven Mesko, Wyoming, OH (US); Michael E. Berger, Brooklyn, NY (US); Adem Önalan, Jersey City, NJ (US); Marco C. Perry, Brooklyn, NY (US)

(73) Assignee: Cintas Corporate Services, Inc., Cincinnati, OH (US)

( * ) Notice: Subject to any disclaimer, the term of this patent is extended or adjusted under 35 U.S.C. 154(b) by 37 days.

(21) Appl. No.: 17/465,188

(22) Filed: Sep. 2, 2021

(65) Prior Publication Data

US 2022/0167803 A1 Jun. 2, 2022

Related U.S. Application Data

(60) Provisional application No. 63/119,807, filed on Dec. 1, 2020.

(51) Int. Cl.
*A47K 10/42* (2006.01)
*A47K 10/32* (2006.01)

(52) U.S. Cl.
CPC ..... *A47K 10/422* (2013.01); *A47K 10/425* (2013.01); *A47K 2010/3233* (2013.01)

(58) Field of Classification Search
CPC ..... A47K 10/422
USPC ..... 221/45
See application file for complete search history.

(56) References Cited

U.S. PATENT DOCUMENTS

| | | | | |
|---|---|---|---|---|
| 3,840,146 | A | 10/1974 | Bodek | |
| 5,118,554 | A | 6/1992 | Chan et al. | |
| 5,931,339 | A | 8/1999 | Dodge et al. | |
| 6,070,756 | A | 6/2000 | Dodge et al. | |
| 6,889,868 | B2 * | 5/2005 | Magid | G07B 5/02 221/45 |
| 7,546,973 | B2 | 6/2009 | Budz et al. | |
| 8,152,021 | B2 | 4/2012 | Babikian | |
| 8,297,160 | B2 | 10/2012 | Friesen et al. | |
| 2006/0273102 | A1 * | 12/2006 | Wieser | A47K 10/422 221/56 |
| 2014/0246450 | A1 * | 9/2014 | Marietta-Tondin | A47K 10/38 221/63 |

(Continued)

*Primary Examiner* — Gene O Crawford
*Assistant Examiner* — Ayodeji T Ojofeitimi
(74) *Attorney, Agent, or Firm* — Wood Herron & Evans LLP

(57) ABSTRACT

Dispensers are capable of being used in one orientation for dispensing paper towels upwardly when situated on a countertop and also in a second orientation for dispensing paper towels downwardly when mounted on a wall or other surface. Moreover, the dispensers can be easily modified to present a different finish by installing the desired outer shell components on the dispenser. The dispenser utilizes an inner cartridge adapted to house a stack of interleaved paper towels. The paper towels are urged by a spring toward a dispensing slot situated on a housing surrounding the cartridge. The spring urges the leading paper towel in the stack toward the dispensing slot in either orientation for convenient access to the towel by a user.

19 Claims, 15 Drawing Sheets

(56) References Cited

U.S. PATENT DOCUMENTS

2016/0088982 A1* 3/2016 Larsson ..... B65B 5/06
221/45

* cited by examiner

MULTI-ORIENTATION TOWEL DISPENSER

This claims the benefit of U.S. Provisional Patent Application Ser. No. 63/119,807, filed Dec. 1, 2020 and hereby incorporated by reference in its entirety.

BACKGROUND OF THE INVENTION

This invention relates to a process and apparatus for dispensing paper towels, and more particularly for a stack of interfolded paper towels. For this invention, the term "paper towel" is intended to broadly cover all sheet paper products designed to dry or clean surfaces including, for example, napkins, wipes, towels and tissues as well as other items generally referred to as paper towels.

Individual paper towels are frequently dispensed from a stack of interfolded or C-fold paper towels. The paper towels can have a single-fold or multifold construction. A single-fold paper towel is formed from a rectangular sheet which has one fold line extending generally parallel to the two side edges of the sheet. The fold line subdivides the sheet into two sections which are usually of equal size. When stacked, the sections of each paper towel are superposed and adapted to receive therebetween one section from each of the two adjacent towels. The fold lines of the two adjacent paper towels are opposed to the fold line of the first towel. Further, the two adjacent towels will each receive one section of the first towel between their overlapping sections.

One form of multifold paper towel is interfolded in a stack much like a single fold paper towel. These towels include a plurality of fold lines to define a multiple of overlapping sections arranged in an accordion style. In a stack, one section of each paper towel is received between a pair of sections of each adjacent paper towel. Another form of multifold paper towel is the C-fold paper towel. A C-fold paper towel is formed from a single sheet and folded to have a generally C-shaped configuration. While the towels are stacked for dispensing, they are not interfolded together.

A stack of paper towels may be dispensed from an enclosed bin provided with an elongate opening along its bottom surface. Typically, this type of dispenser may be mounted on a wall in a kitchen, bathroom, workshop or other environment. One section of the bottommost paper towel protrudes from the opening to be grasped and dispensed by a user. In an interfolded stack such as that disclosed in U.S. Pat. No. 5,118,554, incorporated herein by reference in its entirety, pulling a paper towel from the bin will cause the lower section of the next paper towel to protrude from the opening. In a stack of C-fold towels, a flap of the next towel is exposed for grasping after the bottommost towel is removed. However, in either case, multiple towels are occasionally dispensed when the bottommost towel is pulled out of the opening. The risk of dispensing multiple towels is particularly acute when the stack is low, and less weight and friction are available to hold the remaining towels in the bin.

Interfolded paper towels may also be dispensed from an opening in the top of an enclosed box. Typically, this type of dispenser is located on a countertop or other horizontal surface in a kitchen, bathroom, workshop or other environment. In essentially the same way, pulling the uppermost paper towel out of the box causes one section of the next paper towel to protrude from the opening. However, as the stack becomes smaller, a larger and larger gap is formed between the opening and the top of the stack.

Finally, many dispensers are provided to a commercial, industrial or retail establishment by a service provided such as Cintas®, the assignee of this invention. Such providers of service equipment must stock and inventory a wide variety of equipment. It is duplicative and cumbersome to stock and provide multiple types of paper towel dispensers, such as wall mounted bottom dispensers and countertop top dispensers. The problem is multiplied when a variety of finishes are available and each finish must be available in both wall mounted and countertop paper towel dispensers.

Therefore, a need exists in the art for an improved paper towel dispenser that does not suffer from these and other drawbacks with the prior art.

SUMMARY OF THE INVENTION

These and other shortcomings in the prior art have been addressed by this invention, which in various embodiments is a multi-orientation paper towel dispenser. Dispensers of this invention are capable of being used in one orientation for dispensing paper towels upwardly when situated on a countertop and also in a second orientation for dispensing paper towels downwardly when mounted on a wall or other surface. Moreover, the dispensers of various embodiments of this invention can be easily modified to present a different finish by installing the desired outer shell components on the dispenser. As such, a single dispenser can be employed in a variety of orientations, appearances and environments thereby reducing the number of dispenser types required for supplying a variety of installations.

In various embodiments, a dispenser of this invention utilizes an inner cartridge adapted to house a stack of interleaved paper towels. The paper towels are urged by a spring toward a dispensing slot situated on a housing surrounding the cartridge. A cover may be provided on an end of the housing opposite from the dispensing slot. As such, the dispenser of this invention may be utilized in an upward dispensing orientation when situated on a countertop or the like or in a downward dispensing orientation when mounted on a wall. The spring urges the leading paper towel in the stack toward the dispensing slot in either orientation for convenient access to the towel by a user.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
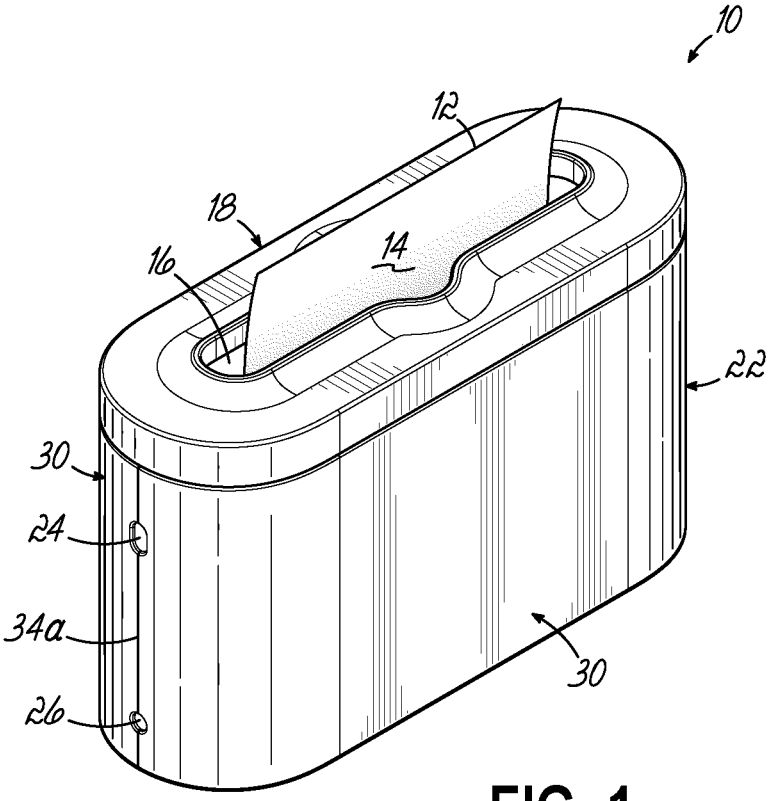
FIG. 1 is a perspective view of one embodiment of a paper towel dispenser in a first orientation according to this invention.
Figure 2:
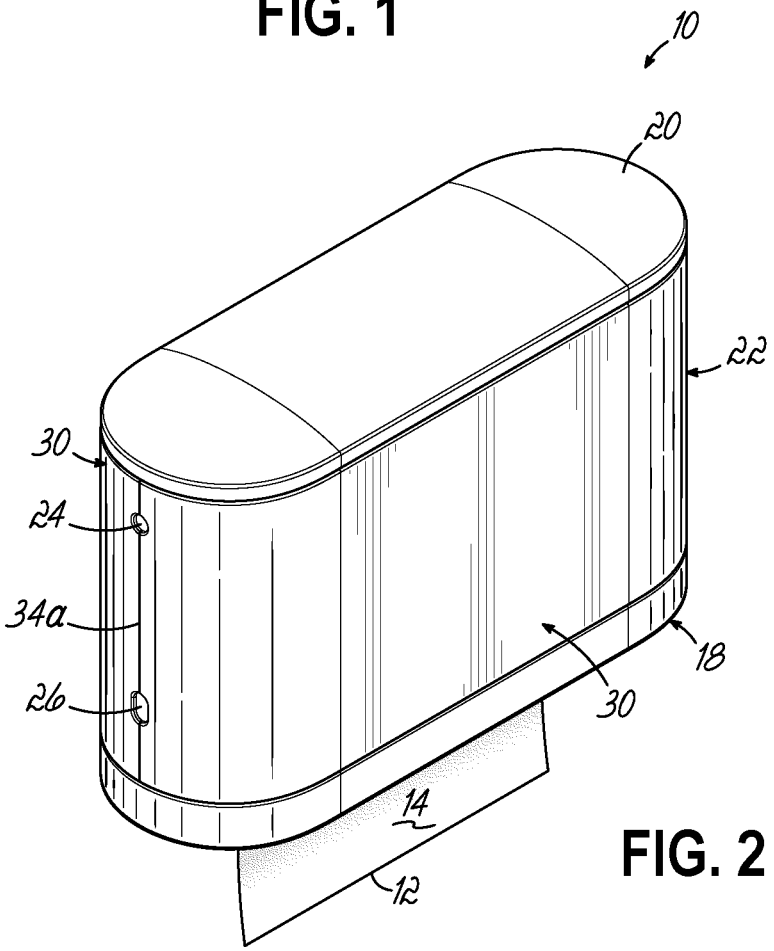
FIG. 2 is view similar to FIG. 1 with the dispenser in a second orientation.

Referring to FIG. 1, an embodiment of a paper towel dispenser 10 according to this invention is shown in a first orientation with leading edge 12 of a paper towel 14 projecting upwardly through a dispensing slot 16 in a cap 18 of the dispenser 10. In the first orientation, rubber or other material feet 19 (FIGS. 4-7) may be installed on the end of the dispenser 10 opposite from the cap 18 to support the dispenser 10 on a countertop or other surface. In FIG. 2, the dispenser 10 is shown in a second orientation with the leading edge 12 of the paper towel 14 projecting downwardly from the dispensing slot 16. A cover 20 is mounted on the end of the dispenser 10 opposite from the cap 18 and slot 16. The dispenser 10 of FIGS. 1-2 includes a housing 22 positioned between the cap 18 and the cover 20. A viewing port 24 and an access port 26 are formed in a longitudinal end of the housing 22. The purpose and function of the ports 24, 26 will be detailed hereinbelow.

Figure 3:
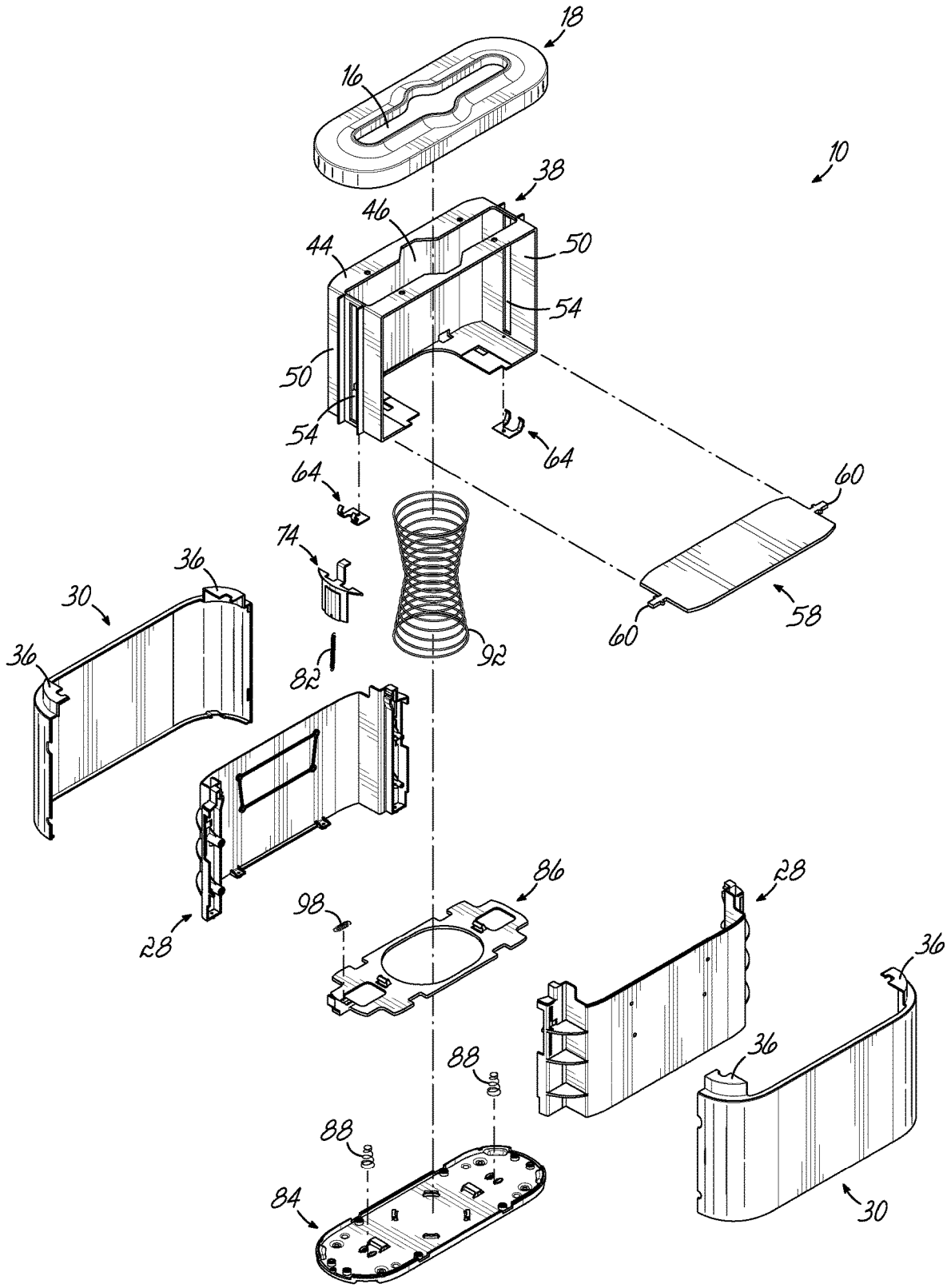
FIG. 3 is an exploded perspective view of the components of the dispenser of FIG. 1.
Figure 3A:
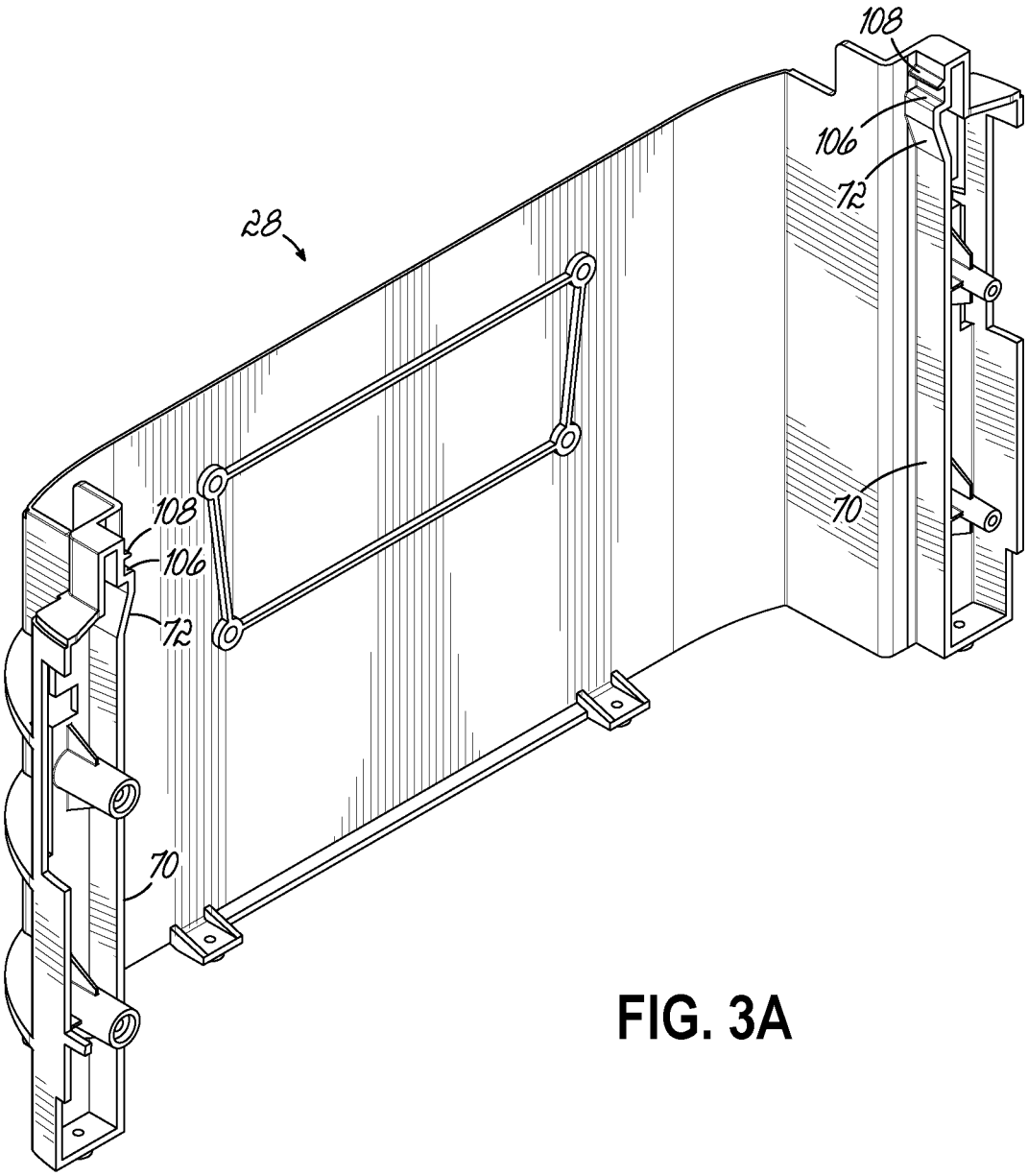
FIGS. 3A-3F are enlarged perspective views of select components shown in FIG. 3.
Figure 3B:
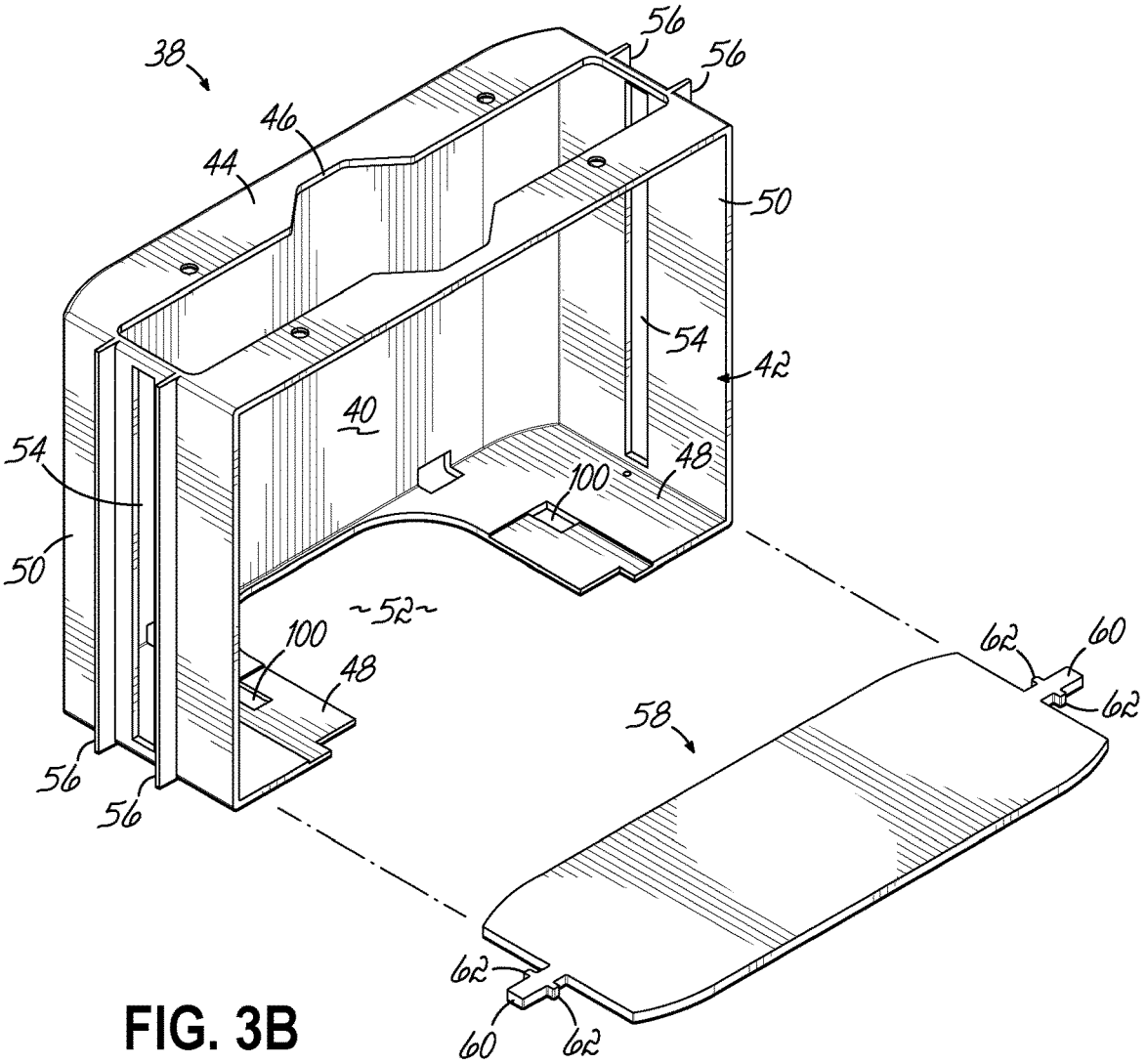
Figure 3C:
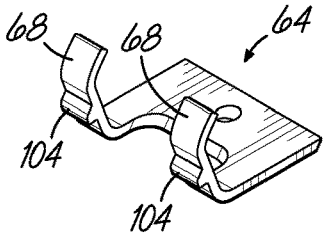
Figure 3D:
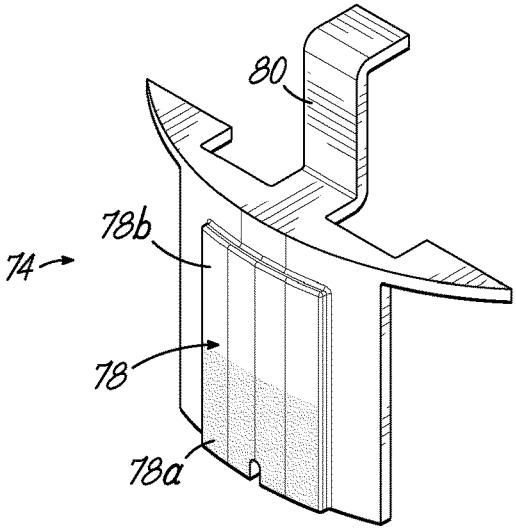
Figure 3E:
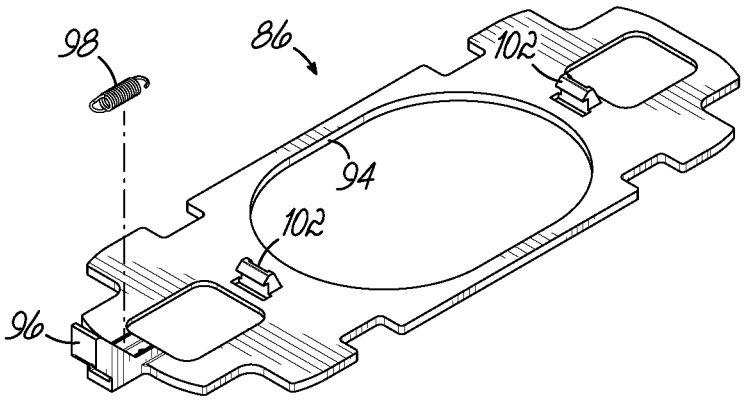
Figure 3F:
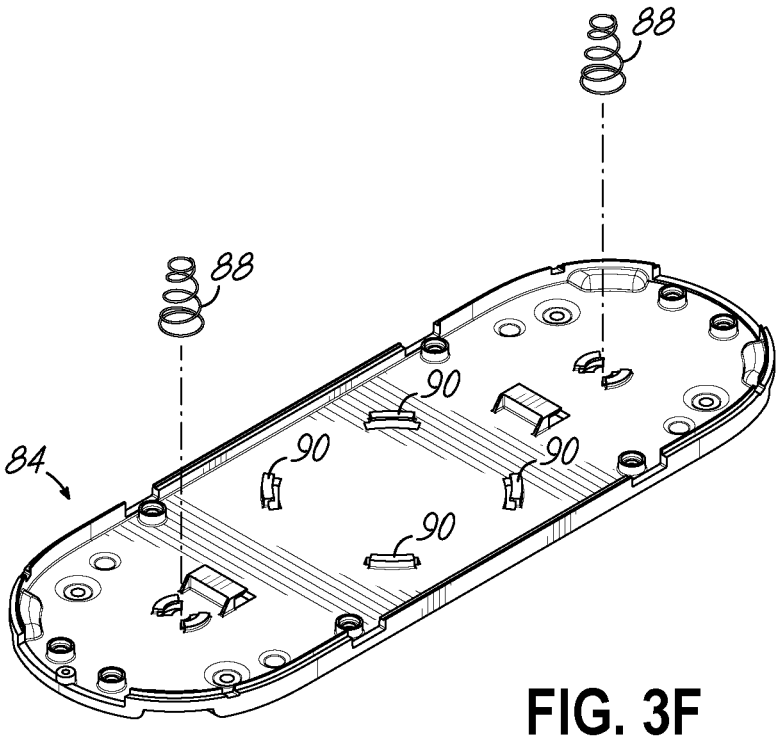

The components of the dispenser 10 according to one embodiment of this invention are shown in FIG. 3 in the first orientation. The housing 22 according to this embodiment includes a pair of inner shell members 28 and a pair of outer shell members 30. The inner and outer shell members 28, 30 mate with the associated member along joints 32, 34, respectively, extending generally vertically at longitudinal ends of the dispenser 10. Complimentary portions of the ports 24, 26 are formed in each outer shell member 30 adjacent to one of the joints 34*a*. A pair of posts 36 extend upwardly from an upper edge of each outer shell member 30 adjacent to each joint 34. The cap 18 sits atop the upper edge of each outer shell member 30 and is positioned on the housing 22 by the posts 36. It will be appreciated by one of ordinary skill in this art that the outer shell 30 may have a first finish and the appearance of the dispenser 10 may be modified by removing the outer shell 30 and replacing it with another outer shell 30 of a different finish. Likewise, the finish of the cap 18 may be altered by installing a cap 18 of a different finish complimentary to the finish of the outer shell 30.

A cartridge 38 is captured within the inner shell members 28 and has a generally rectangular shape with one sidewall 40 opposite from an open face 42 of the cartridge 38. The cartridge 38 also has a split top wall 44 with an outlet 46 extending longitudinally along the top wall 44 thereof. Opposite from the top wall 44 is a pair of cartridge bottom flanges 48 each extending inwardly from a cartridge end wall 50. Each bottom flange 48 is also joined to a bottom edge of the sidewall 40. A spring access duct 52 is formed between the bottom flanges 48. Each end wall 50 has a vertically oriented open channel 54 formed therein and a pair of outwardly oriented and spaced vertical ribs 56 flank each side of each channel 54. A latch mechanism may releasably retain the cartridge 38 within the housing 22. In one embodiment, the latch mechanism includes a generally rectangular pusher plate 58 captured within the cartridge 38 for vertical movement to and between the bottom flanges 48 and the top wall 44. A pair of stubshafts 60 each project along a longitudinal centerline of the pusher plate 58 from a longitudinal end of the plate 58. A pair of detents 62 are formed on each stubshaft 60 and extend laterally in opposite directions from the side edges of the stubshaft 60. When the pusher plate 58 is captured in the cartridge 38, each stubshaft 60 extends into one of the open channels 54 and the detents 62 help to retain the stubshafts 60 in the open channels 54 and the pusher plate 58 in the cartridge 38.

A pair of spring clips 64 are each fastened to one of the bottom flanges 48 of the cartridge 38 by one of a pair of screws 66. Each spring clip 64 has a spring clip arm 68 which extends outwardly from the clip 64 and is captured within a rail 70 formed proximate the joint 32 of the inner shell members 28. A sloped brace 72 is formed at an upper edge of the rail 70. An indicator 74 is captured within an outer passage 76 formed at the joint 32 of the inner shell members 28. The indicator 74 has an indicator face 78 and an upwardly extending arm 80. The indicator 74 is coupled to an indicator extension spring 82 to bias the indicator 74 to position a "filled" portion of the indicator face 74 to be exposed and visible through the viewing port 24 in the outer shell 30.

An oval shaped panel 84 is at a bottom end of the housing 22 when the dispenser 10 is in the first orientation of FIGS. 1 and 3. A lock plate 86 is juxtaposed between an inner face of the panel 84 and the bottom flanges 48 of the cartridge 38. A pair of conical springs 88 is sandwiched between the bottom flanges 48 and lock plate 86. The panel 84 has a number of spring retainers 90 on its inner face to secure an end of an hourglass shaped spring 92 to the panel 84. The spring 92 extends from the panel 84 and through a spring hole 94 in the lock plate 86 and the spring access duct 52 in the cartridge 38 to engage a face of the pusher plate 58. A release tab 96 extends from an end of the lock plate 86 adjacent to the access port 26. The lock plate 86 is coupled to an extension spring 98 proximate the release tab 96 to bias the lock plate 86 toward the access port 26. In the second orientation of FIG. 2, the cover 20 is snapped onto the dispenser 10 to cover the panel 84.

Figure 4:
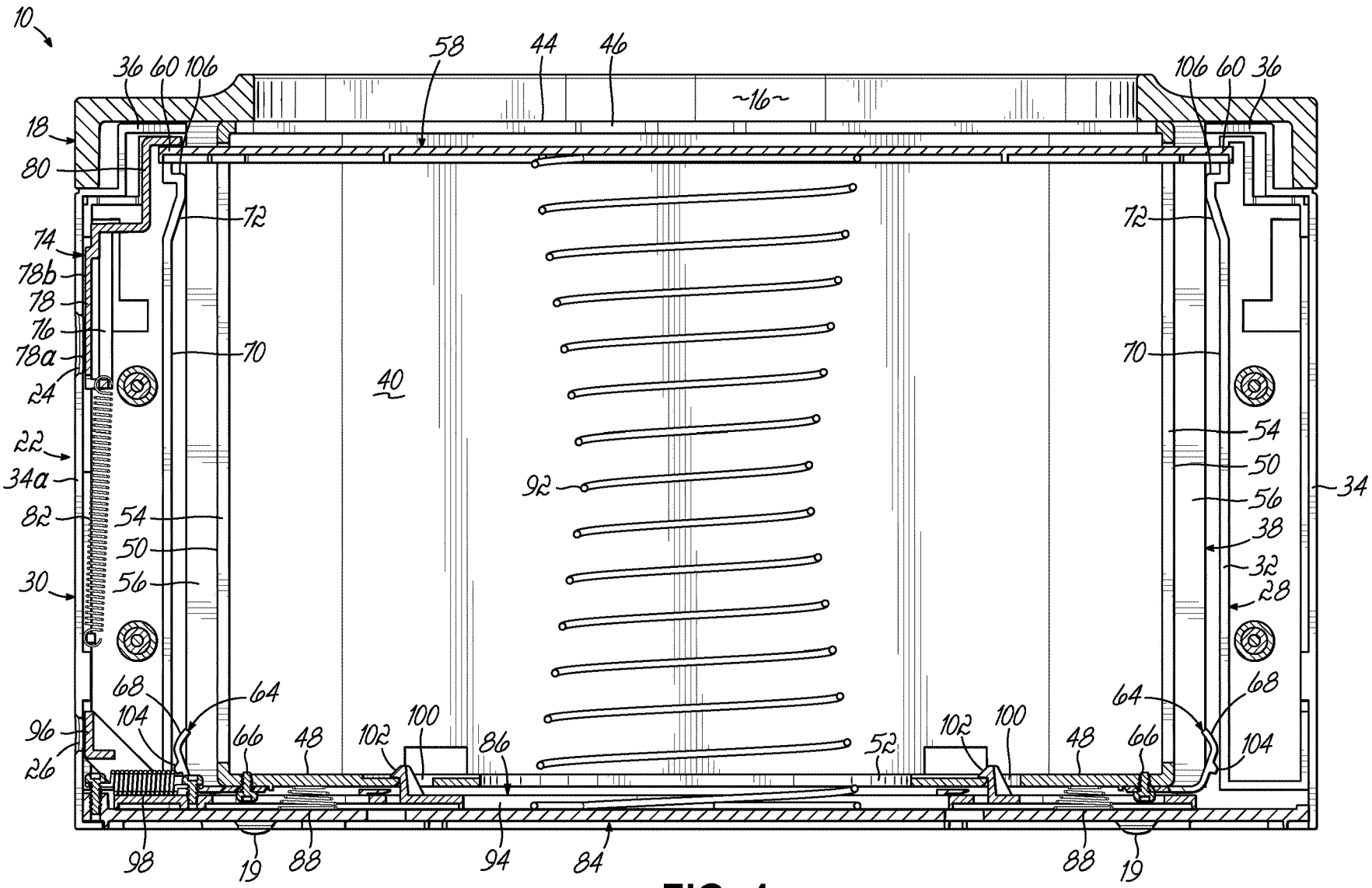
FIG. 4 is a cross sectional view of the dispenser of FIG. 1.

Referring to FIG. 4, a cross sectional view of the dispenser 10 according to this embodiment of the invention is shown without paper towels loaded therein. The access port 26 is covered by the release tab 96 at the interior of the outer shell 30. The viewing port 24 is covered by a first portion 78*a* of the face 78 on the indicator 74. The face 78 also includes a second portion 78*b* and the first and second portions 78*a*, 78*b* may be colored differently to indicate to a user whether the cartridge 38 has paper towels 14 loaded therein or not. Since the cartridge 38 in FIG. 4 does not have paper towels therein, the first portion 78*a* of the face 78 is visible through the viewing port 24 and the spring 82 coupled to the indicator 74 is extended.

Figure 5:
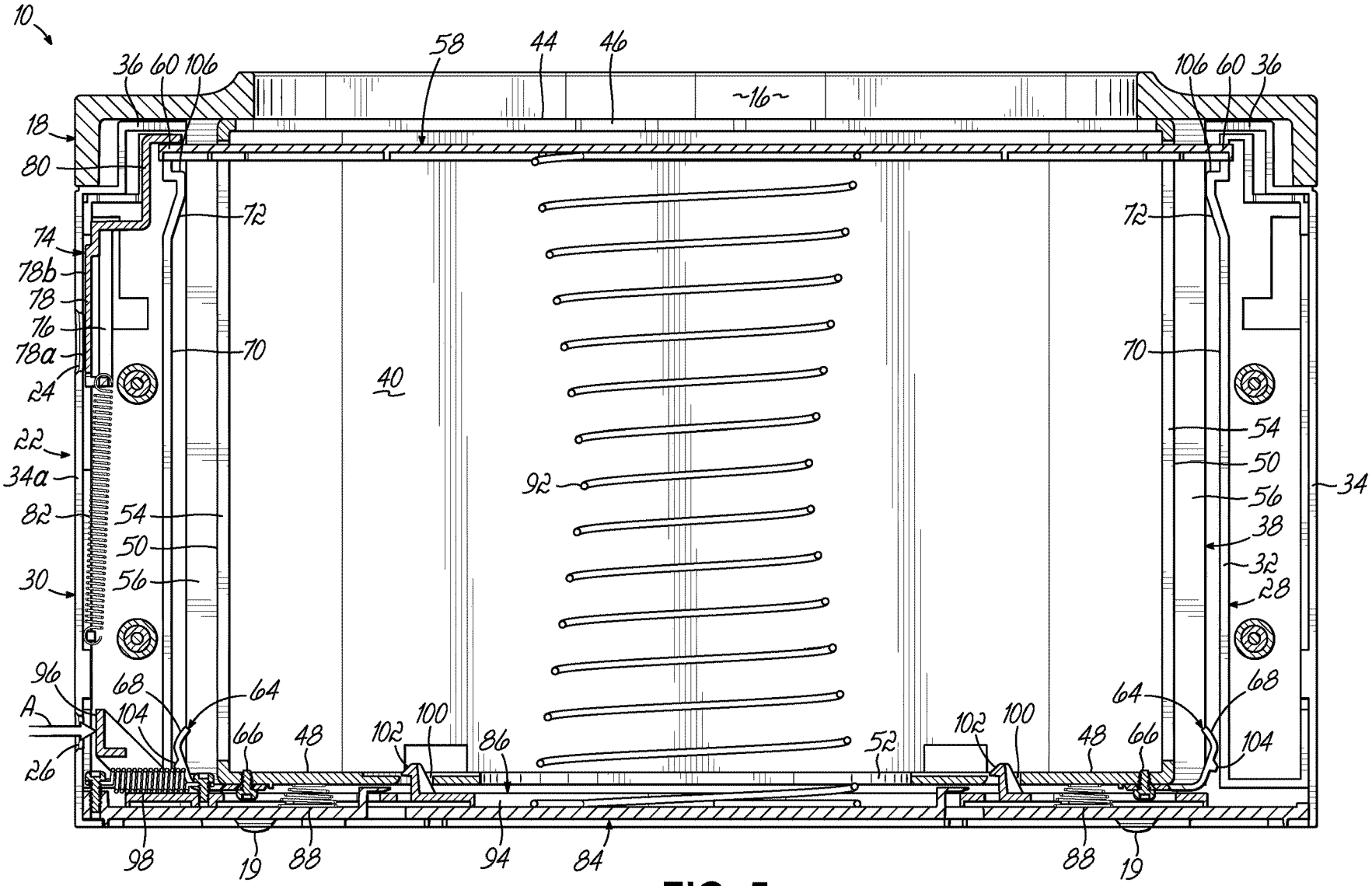
FIGS. 5-7 are sequential views similar to FIG. 4 showing the release and upward movement of a cartridge within a housing of the dispenser.

One method of loading the dispenser 10 with paper towels 14 begins in FIG. 5 by a user inserting a probe, tool, key or other device (not shown) into the access port 26 as indicated by arrow A and depressing the release tab 96. Movement of the release tab 96 in the direction of arrow A toward the interior of the housing 22 overcomes the bias of release spring 98 connected thereto. The inward movement of the release tab 96 slides the lock plate 86 connected thereto in a similar direction which is to the right in FIG. 5. The lock plate 86 has a pair of retention hooks 102 spaced on either side of the spring hole 94. Prior to the movement of the release tab 96 and lock plate 86, the cartridge 38 is retained against the lock plate 86 by the retention hooks 102 which extend upwardly from the lock plate 86 and through a pair of release apertures 100 each in one of the bottom flanges 48 of the cartridge 38. The retention hooks 102 are oriented toward the access port 26 so that when the release tab 96 and lock plate 86 move in the direction of arrow A, the retention hooks 102 disengage from the bottom flanges 48 of the cartridge 38 as shown by comparing FIGS. 4 and 5.

Figure 6:
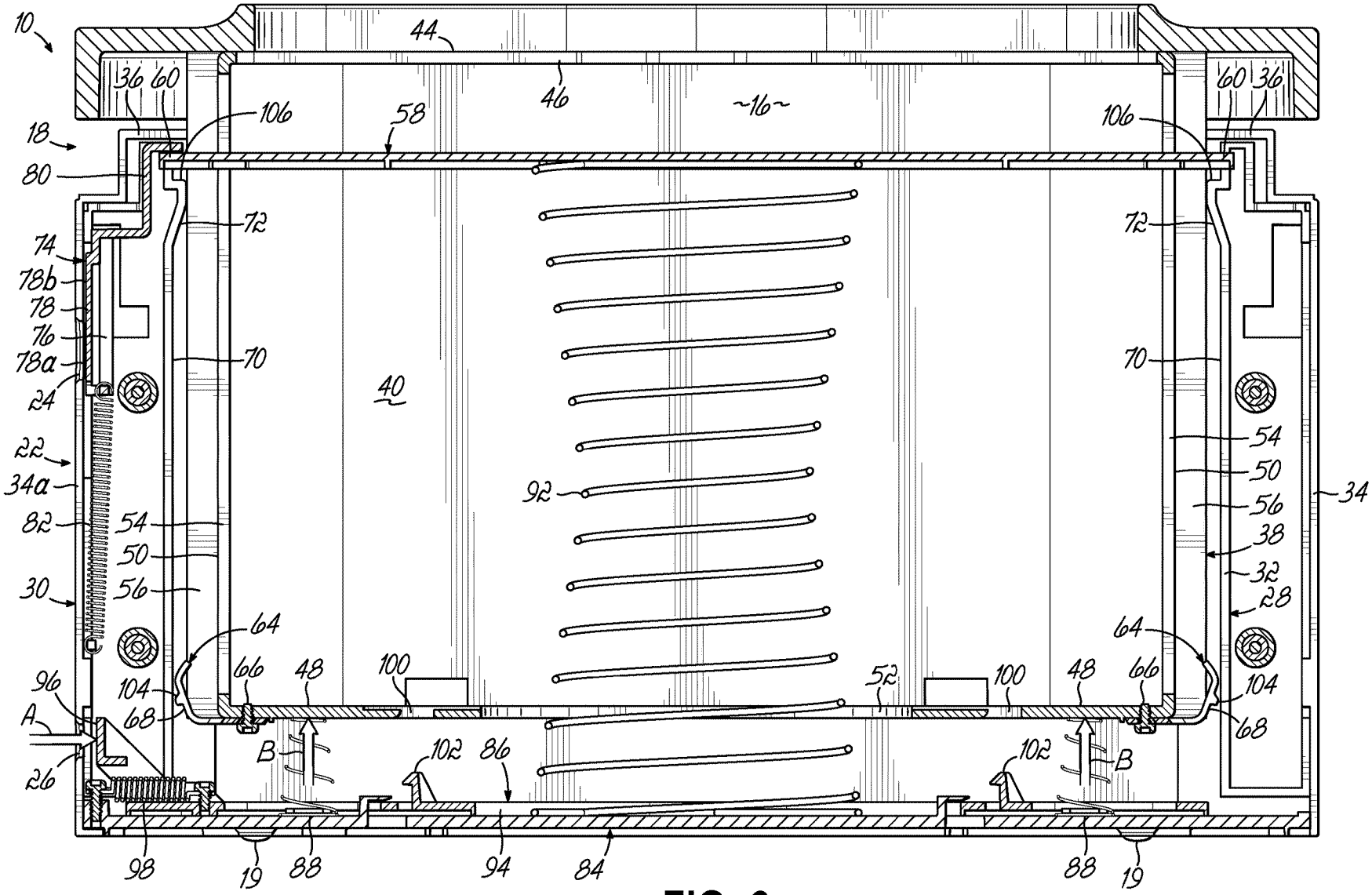
Figure 7:
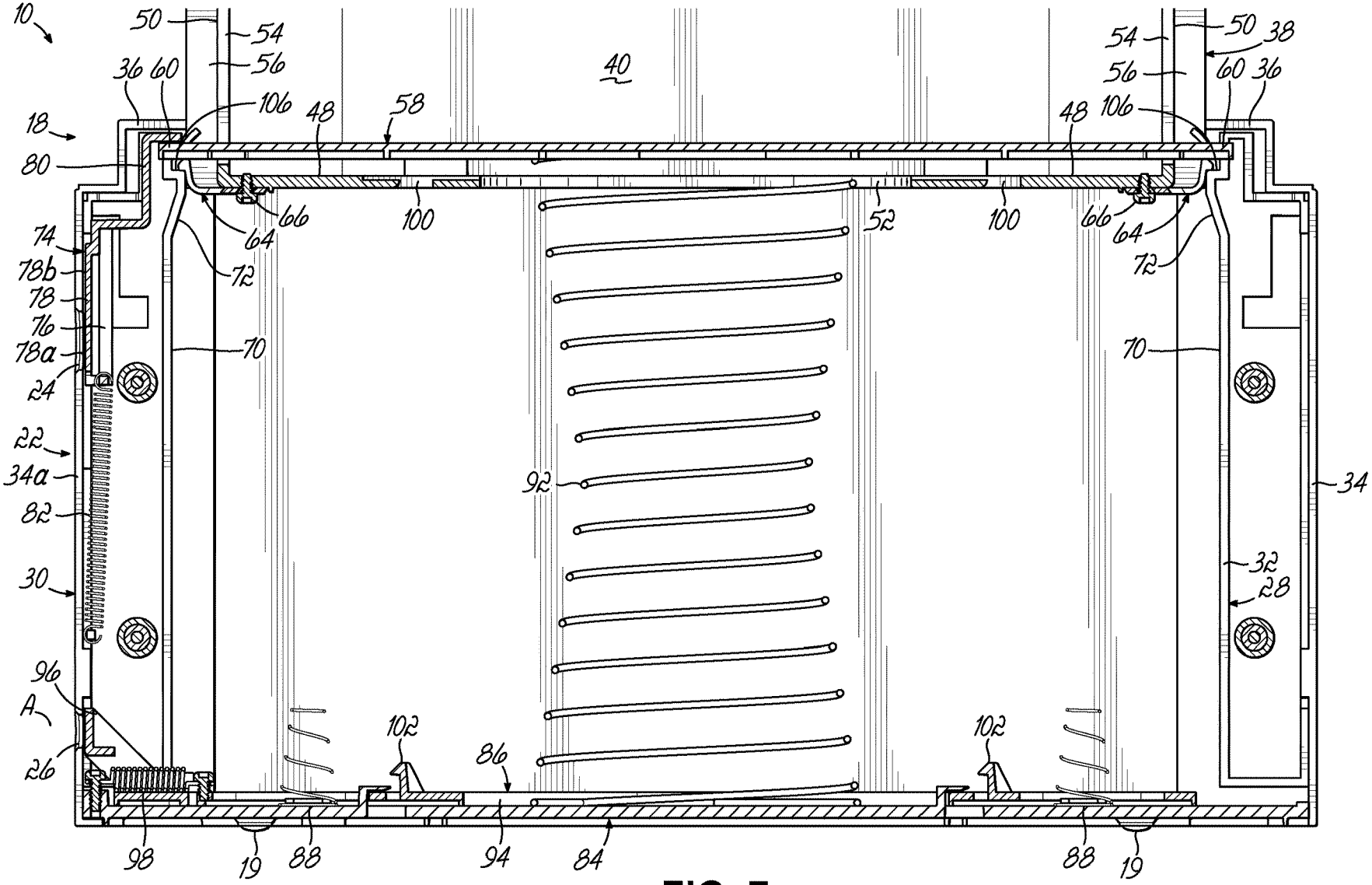
Figure 7A:
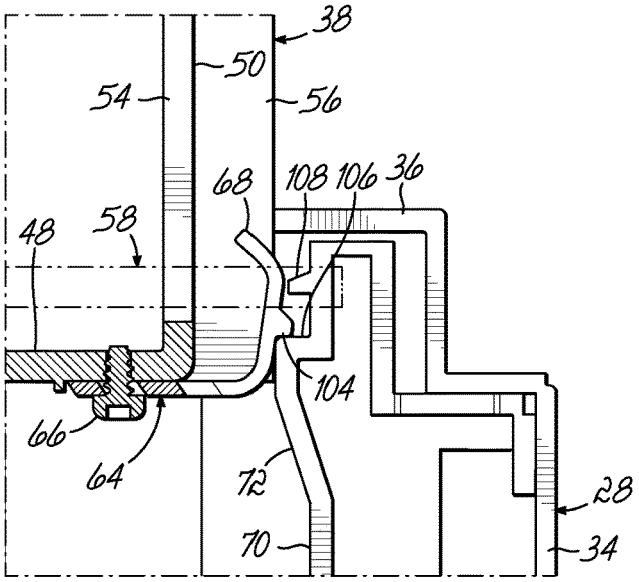
FIG. 7A is an enlarged cross sectional view of a portion FIG. 7 of the engagement of the cartridge with the housing of the dispenser.

Once the cartridge 38 is released from the retention hooks 102 on the lock plate 86, the springs 88 sandwiched between the bottom flanges 48 and the lock plate 86 urge the cartridge 38 upwardly in the direction of arrows B in FIG. 6 and away from the lock plate 86. As a result of the upward movement of the cartridge 38 as shown in FIG. 6, the cap 18 is dislodged from the housing 32. A user may then pull the cartridge 38 and cap 18 away from the housing 22 and expose the open face 42 of the cartridge 38 out of the housing 22. While pulling the cartridge 38 from the housing 22, the spring clips 64 mounted to the cartridge 38 ride within the rails 70 on the inner shell 28 until they reach the sloped brace 72. Once the arms 68 on the spring clips 64 traverse over the sloped brace 72, a latch 104 on each arm 68 hooks onto a shelf 106 on the sloped brace 72 to retain the cartridge 38 in an extended position relative to the housing as shown in FIG. 7. The hourglass spring 92 is extended as shown in FIG. 7 when the open face 42 of the cartridge 38 is free of the housing 22.

Figure 8:
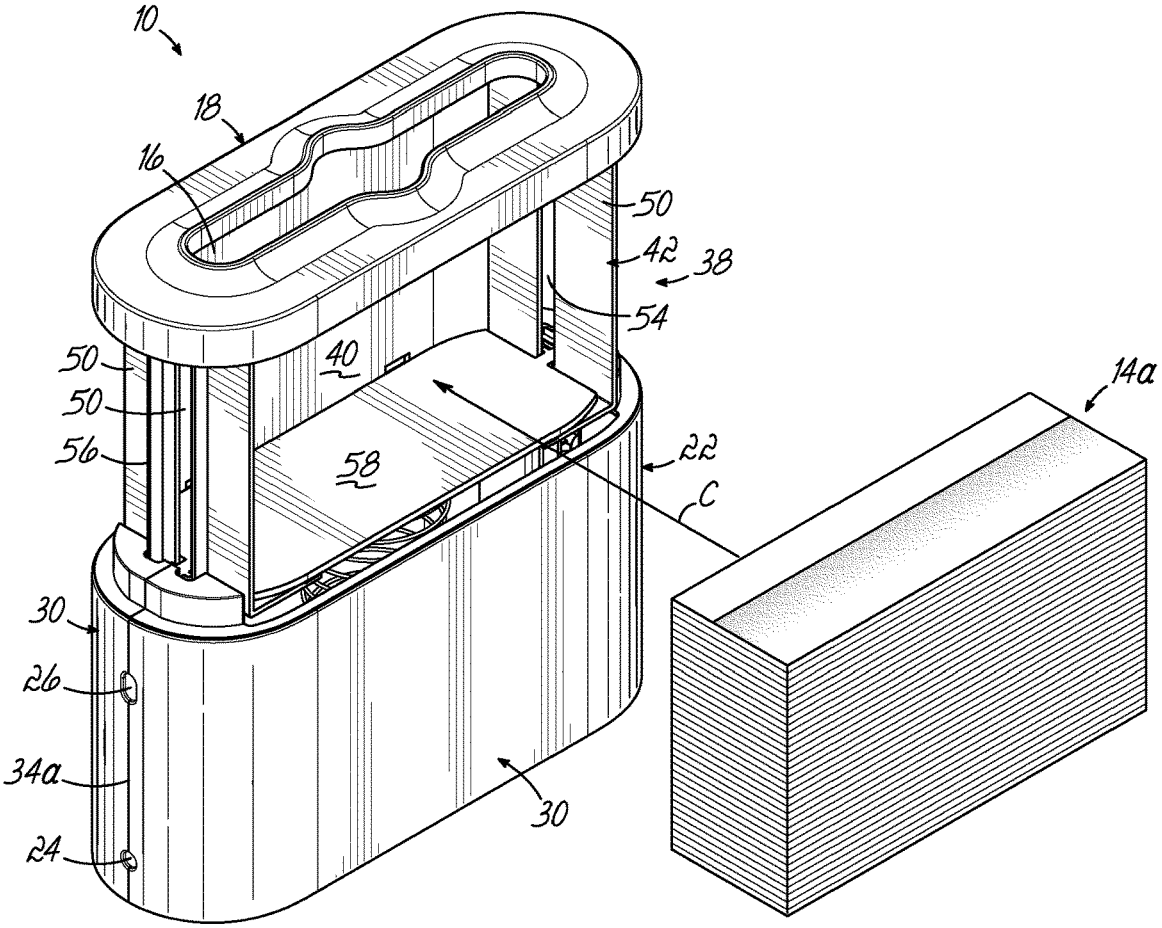
FIG. 8 is a perspective view of a stack of paper towels being loaded in the cartridge of the dispenser of FIG. 1.
Figure 9:
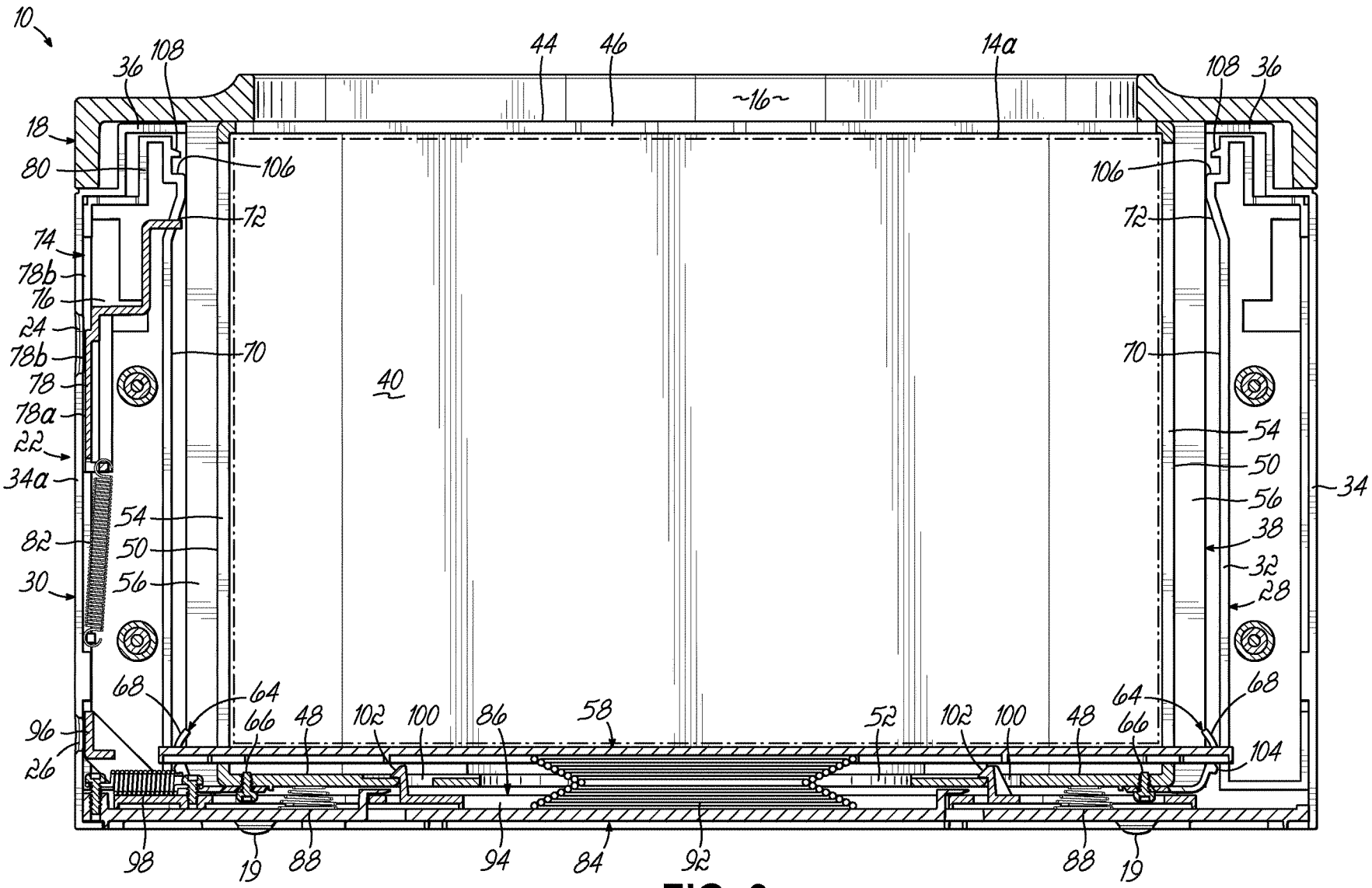
FIG. 9 is a cross sectional view similar to FIG. 4 with the stack of paper towels loaded in the cartridge.
Figure 10:
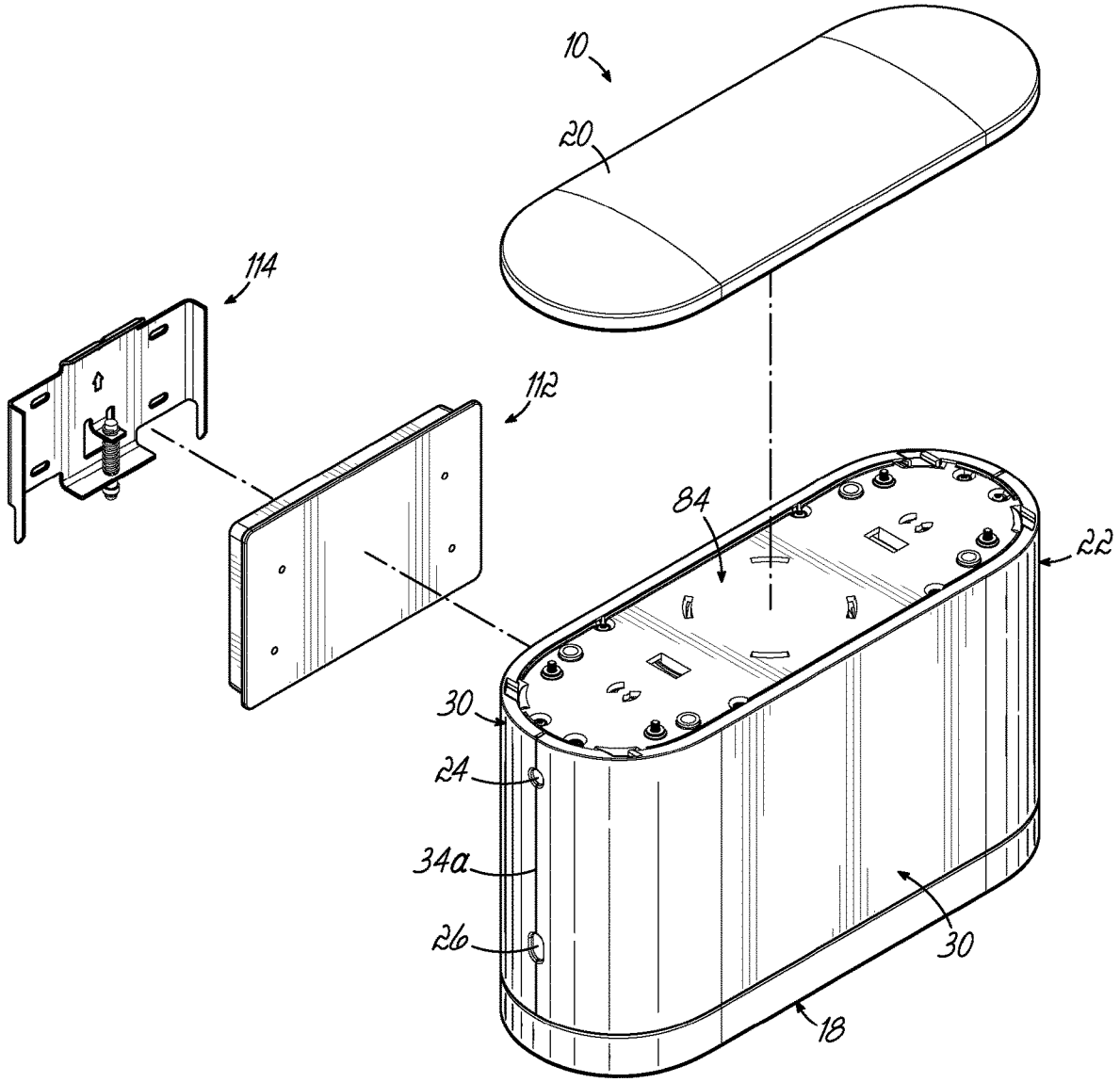
FIG. 10 is a perspective view of the dispenser of FIG. 1 in a second orientation with hardware for mounting the dispenser on a wall.

As shown in FIG. 8, with the cartridge 38 extended from the housing 22, the open face 42 is accessible and a user may insert a stack 14*a* of paper towels 14 into the cartridge 38 in the direction of arrow C. The cartridge 38 with the stack 14*a* of paper towels 14 loaded therein may then be gently pushed back into the housing 22 thereby releasing the latch 104 on each spring clip arm 68 from the associated shelf 104 and compressing the hourglass spring 92. Once the bottom flanges 48 of the cartridge 38 reach the lock plate 86, the retention hooks 102 are urged away from the access port 26 slightly and against the bias of the spring 98 to allow for insertion of the retention hooks 102 once again into the associated release apertures 100 in the bottom flanges 48. The retention hooks 102 then hook onto the bottom flanges 48 to retain the cartridge 38 in the housing 22 with the hourglass spring 92 compressed against the pusher plate 58 and urging the stack 14*a* of paper towels 14 against the dispensing slot 16 in the cap 18. As shown in FIG. 9 with the paper towels 14 loaded in the cartridge 38, the second portion 78*b* of the face 78 on the indicator 74 is presented in the viewing port 24 with the spring 82 compressed thereby indicating paper towels 14 in the cartridge 38.

One of ordinary skill in the art will appreciate that with various embodiments of this invention, the paper towels 14 may be replenished in the dispenser 10 without dismantling the dispenser 10 or removing the housing 22, inner shell 28 or outer shell 30. Moreover, the cartridge 38 may be loaded with paper towels 14 while the dispenser 10 is in the first orientation (FIG. 1) or the second orientation (FIG. 2) and with or without the cover 20 mounted to the dispenser 10. Additionally, the leading edge 12 of the paper towel 14 is conveniently accessible through the dispensing slot 16 to a user and the stack 14*a* of paper towels 14 is urged toward the dispensing slot 16 in both first and second orientations.

Figure 11:
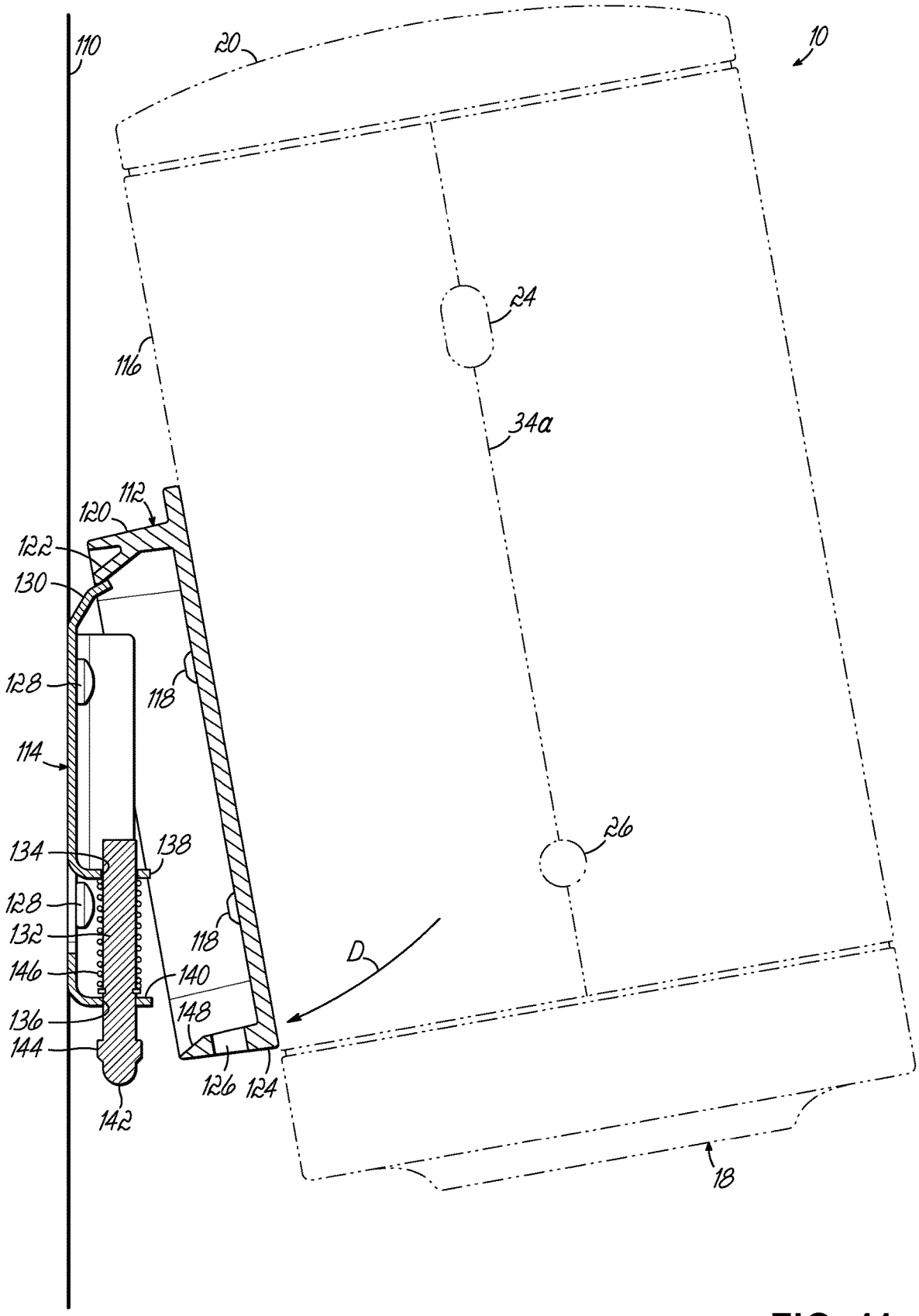
FIGS. 11-13 are partial cross sectional views of the dispenser of FIG. 10 being mounted on the wall with the hardware.
Figure 12:
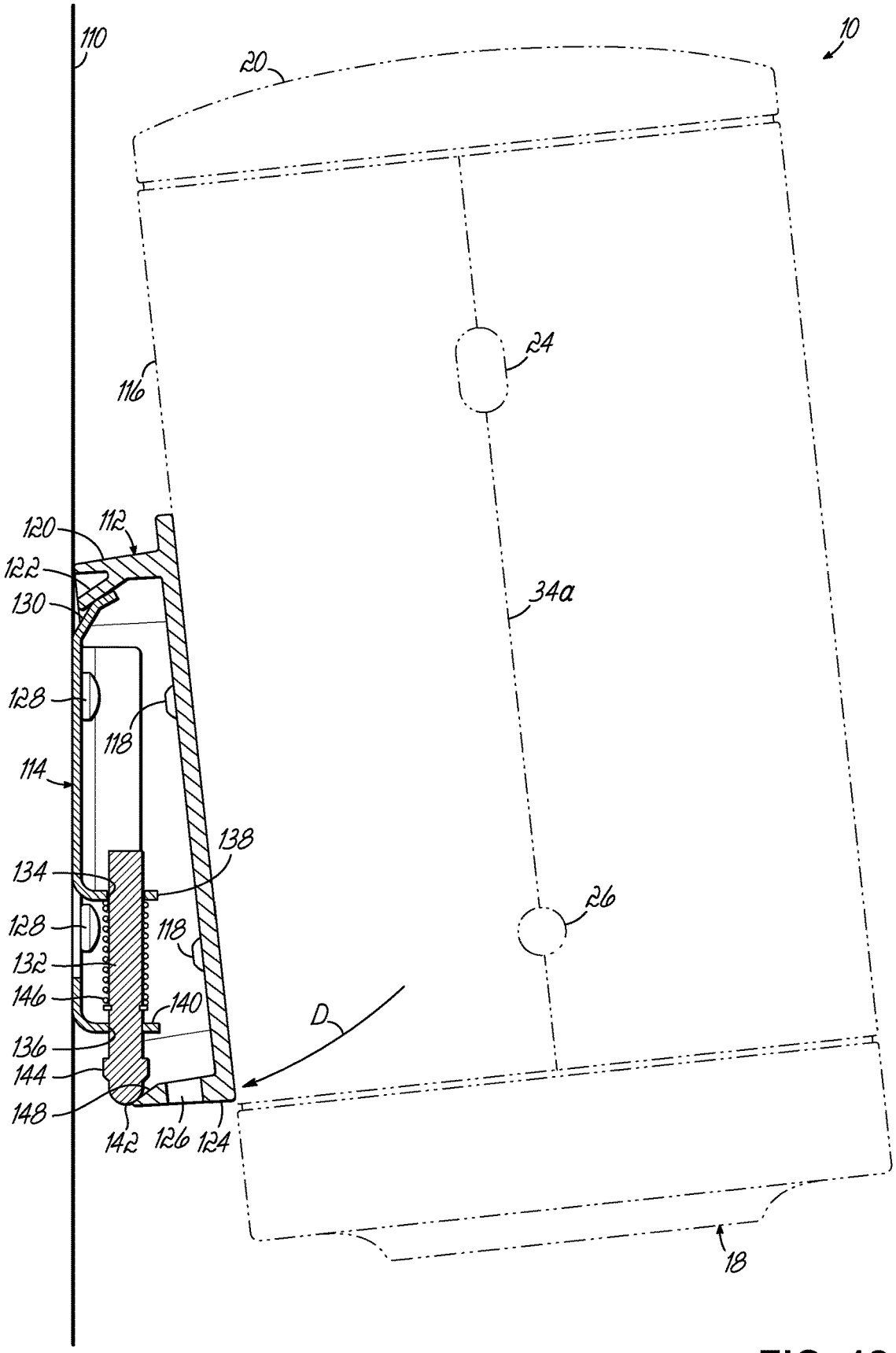
Figure 13:
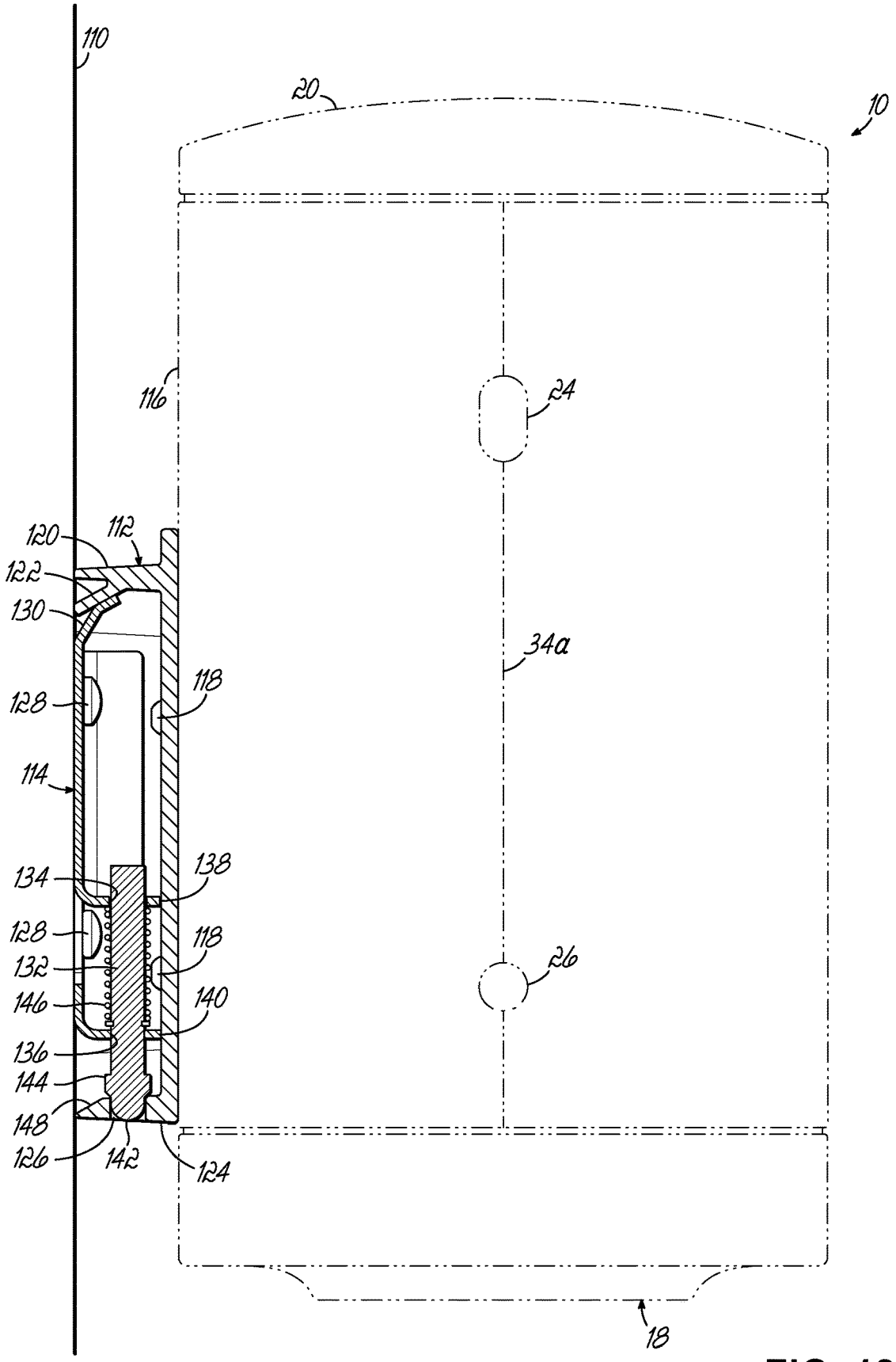

Referring to FIGS. 10-13, one embodiment for mounting the dispenser 10 to a wall 110 or other, typically vertical, surface is shown according to this invention. Commonly, the dispenser 10 will be in the second orientation when mounted to the wall 110, but other orientations are also contemplated within the scope of this invention. In the second orientation with the cap 18 and dispensing slot 16 oriented downwardly, the cover 20 will be installed on the end of the dispenser opposite from cap 18. To mount the dispenser 10 to the wall 110, a mounting assembly which may include a mounting plate 112 and mounting bracket 114 are utilized in the embodiment of FIGS. 10-13. The mounting plate 112 may be mounted to a back face 116 of the dispenser 10 by mounting screws 118 (FIGS. 11-13). The mounting plate 112 has an upper rearwardly projecting flange 120 with an obliquely directed downward strut 122. The mounting plate 112 also has a lower rearwardly projecting ledge 124 with a mounting hole 126 therethrough.

The mounting bracket 114 may be secured to the wall 110 by wall screws 128 and includes an upper obliquely oriented sill 130 adapted to support the flange 120 of the mounting plate 112. A vertically oriented mounting pin 132 is inserted into an upper mounting pin hole 134 and a lower mounting pin hole 136 in upper and lower generally horizontal shelves 138, 140, respectively. The mounting pin 132 may have a head 142 with an annular collar 144. A mounting pin spring 146 surrounds the mounting pin 132 and is captured between the upper and lower shelves 138, 140 to bias the mounting pin 132 downwardly.

The mounting plate 112 and attached dispenser 10 may be mounted to the wall 110 by hooking the strut 122 atop the sill 130 of the mounting bracket 114 as shown in FIG. 11. The dispenser 10 and mounting plate 112 are then pivoted in the direction of arrow D toward the wall no until a leading sloped edge 148 of the ledge 124 on the mounting plate 112 contacts the head 142 of the mounting pin 132 as in FIG. 12. Continued pivotal movement of the cap 18 or lower end of the dispenser 10 toward the wall no will force the pin 132 upwardly as the head 142 slides up the sloped edge 148 of the ledge 124 until the head 142 of the pin 132 is seated in the mounting hole 126 on the mounting plate 112. The pin spring 146 urges the pin 132 toward the ledge 124 to be seated in the hole 126. The dispenser 10 is then releasably, but securely mounted to the wall 110 as shown in FIG. 13.

The dispenser 10 may be removed from the wall no by pushing the head 142 of the pin 132 upward until it is unseated from the mounting hole 126 and then the ledge 124 and lower end of the dispenser 10 may be pivoted away from the wall 110 and the flange 120 removed from the sill 130 of the mounting bracket 114.

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

We claim:

1. A paper towel dispenser comprising:

a cassette adapted to hold a plurality of paper towels therein;

a housing surrounding the cassette;

a dispensing slot in the housing through which the plurality of paper towels may be serially dispensed, the dispensing slot being at a first end of the housing;

wherein the dispensing slot and first end are oriented upwardly when the housing is in a first orientation;

wherein the dispensing slot and first end are oriented downwardly when the housing is in a second orientation; and a cover on a second end of the housing opposite from the dispensing slot when the housing is in the second orientation;

the plurality of paper towels being serially dispensed from the housing when the housing is in each of the first and second orientations.

2. The dispenser of claim 1 further comprising:
a viewing port in the housing through which a user may ascertain a quantity of the plurality of paper towels in the cartridge.

3. The dispenser of claim 1 wherein the housing further comprises:
a pair of inner shell members; and
a pair of outer shell members.

4. The dispenser of claim 1 wherein the housing further comprises:
a cap proximate the first end having the dispensing slot therein.

5. The dispenser of claim 1 wherein the first and second orientations are 180° apart.

6. The dispenser of claim 1 further comprising:
a mounting assembly coupled to the housing for mounting the dispenser to a vertical surface when the housing is in the second orientation.

7. The dispenser of claim 1 wherein the plurality of paper towels are in a stack, the dispenser further comprising:
a pusher plate positioned on an end of the stack opposite from the dispensing slot; and
a spring acting upon the pusher plate to urge the stack toward the dispensing slot.

8. The dispenser of claim 1 further comprising:
a latch mechanism which releasably retains the cartridge within the housing such that when the latch mechanism is released the cartridge is at least partially extended from within the housing to allow insertion of the plurality of paper towels into the cartridge without disassembly of the housing, the latch mechanism being actuated upon insertion of the cartridge into the housing to retain the cartridge and the plurality of paper towels therein, the latch mechanism being operable in each of the first and second orientations.

9. The dispenser of claim 8 further comprising:
an access port in the housing through which a user may release the latch mechanism.

10. A paper towel dispenser comprising:
a cassette adapted to hold a plurality of paper towels therein arranged in a stack;
a housing surrounding the cassette;
a dispensing slot in the housing through which the plurality of paper towels may be serially dispensed, the dispensing slot being at a first end of the housing;
wherein the dispensing slot and first end are oriented upwardly when the housing is in a first orientation;
wherein the dispensing slot and first end are oriented downwardly when the housing is in a second orientation;
wherein the first and second orientations are 180° apart;
a pusher plate positioned on an end of the stack opposite from the dispensing slot;
a spring acting upon the pusher plate to urge the stack toward the dispensing slot; and
a cover on a second end of the housing opposite from the dispensing slot when the housing is in the second orientation;
the plurality of paper towels being serially dispensed from the housing when the housing is in each of the first and second orientations.

11. The dispenser of claim 10 further comprising:
a mounting assembly coupled to the housing for mounting the dispenser to a vertical surface when the housing is in the second orientation.

12. The dispenser of claim 10 further comprising:
a latch mechanism which releasably retains the cartridge within the housing such that when the latch mechanism is released the cartridge is at least partially extended from within the housing to allow insertion of the plurality of paper towels into the cartridge without disassembly of the housing, the latch mechanism being actuated upon insertion of the cartridge into the housing to retain the cartridge and the plurality of paper towels therein, the latch mechanism being operable in each of the first and second orientations.

13. The dispenser of claim 12 further comprising:
an access port in the housing through which a user may release the latch mechanism.

14. The dispenser of claim 10 further comprising:
a viewing port in the housing through which a user may ascertain a quantity of the plurality of paper towels in the cartridge.

15. The dispenser of claim 10 wherein the housing further comprises:
a pair of inner shell members; and
a pair of outer shell members.

16. The dispenser of claim 10 wherein the housing further comprises:
a cap proximate the first end having the dispensing slot therein.

17. A method for filling a paper towel dispenser with a stack of paper towels, the method comprising:
releasing a latch mechanism thereby enabling a spring to urge a cassette from a housing of the paper towel dispenser in either a first direction or an opposite second direction depending upon an orientation of the housing, the cassette having an open face sized and configured to receive there through the stack of paper towels;
inserting the stack of paper towels into the cassette via the open face;
collapsing the cassette with the stack of paper towels therein into the housing; and
engaging the latch mechanism to thereby releasably retain the cassette and stack of paper towels within the housing.

18. The method of claim 17 wherein the releasing step further comprises:
inserting a probe through an access port in the housing and thereby releasing the latch mechanism.

19. The method of claim 17 further comprising:
mounting the housing to a vertical surface with the first direction being downward;
wherein the collapsing step further comprises moving the cassette upwardly into the housing.

* * * * *